US008502063B1

(12) United States Patent
Rivoli

(10) Patent No.: US 8,502,063 B1
(45) Date of Patent: Aug. 6, 2013

(54) MINIATURE TORPEDO

(75) Inventor: Louis David Rivoli, Cedar Hill, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 13/494,243

(22) Filed: Jun. 12, 2012

(51) Int. Cl.
*F42B 19/00* (2006.01)

(52) U.S. Cl.
USPC ..... 114/20.1; 114/20.2; 114/21.3; 114/23; 89/5

(58) Field of Classification Search
USPC ..... 114/20.1, 20.2, 21.3, 23; 89/5
See application file for complete search history.

(56) References Cited

U.S. PATENT DOCUMENTS

| | | | | |
|---|---|---|---|---|
| 5,247,887 | A * | 9/1993 | Drimmer | 102/399 |
| 6,376,762 | B1 * | 4/2002 | French et al. | 114/22 |
| 6,494,159 | B2 * | 12/2002 | Sirmalis et al. | 114/312 |
| 7,282,634 | B2 * | 10/2007 | Kuklinski | 114/20.1 |
| 2004/0065247 | A1 * | 4/2004 | Horton | 114/322 |

* cited by examiner

*Primary Examiner* — J. Woodrow Eldred
(74) *Attorney, Agent, or Firm* — Joseph M. Rolnicki; Evans & Dixon, LLC

(57) ABSTRACT

A lightweight, miniature torpedo has a contact and attachment assembly that is operable to hold the torpedo to a ship's hull in response to contact with the ship's hull, a chamber containing a plurality of flammable elements that are sequentially ignited and burn against the ship's hull at a combustion temperature that is higher than a melting temperature of the material of the ship's hull, and a propulsion and steering assembly that propels and directs the torpedo through water to the ship's hull. The torpedo is constructed with a size and weight that enables it to be carried by and launched from an unmanned aerial vehicle.

20 Claims, 11 Drawing Sheets

MINIATURE TORPEDO

FIELD

The present invention relates to a miniature torpedo and more particularly, to a lightweight, miniature torpedo that can be carried by and launched from an unmanned aerial vehicle.

BACKGROUND

Typical anti-ship torpedos are too heavy and too large to be carried by and launched from an unmanned aerial vehicle (UAV). A typical torpedo is constructed using heavy plastique explosives. The amount and type of explosives employed in a typical torpedo add significantly to the torpedo's size and weight. As typical, small UAVs have a limited payload capacity, the size and weight of typical, larger torpedoes prohibit their use on smaller scale UAV platforms.

SUMMARY

The miniature torpedo of the present invention overcomes the size and weight disadvantages of conventional torpedoes that prevent them from being carried by and launched from smaller UAVs in addition to significantly increasing the torpedo payload capability of both larger UAVs and conventional manned anti-ship aircraft, and anti sub-surface ship aircraft. The miniature torpedo of the invention has an overall length of approximately 18.5 inches and approximate weight of less than 10 pounds. The miniature torpedo is therefore ideally suited for being carried by and launched from small UAVs while also increasing the torpedo carrying capacity of larger UAVs and conventional manned aircraft.

The miniature torpedo of the invention is basically comprised of a contact and attachment assembly, a chamber containing at least one or more flammable element(s), and an ignition assembly for example magnesium or a magnesium alloy.

The contact and attachment assembly attaches the torpedo to a ship's hull.

One or more flammable element(s) are moveable by a drive mechanism through the chamber and toward the ship's hull.

The ignition assembly ignites one or more flammable element(s) and releases the ignited element(s) from the chamber.

The drive mechanism positions the ignited element against the ship's hull where the high temperature heat of the burning element(s) melt a hole through the ship's hull.

The miniature torpedo also includes a propulsion and steering assembly that is operable to propel and steer the torpedo through water below the water line.

The miniature torpedo also includes a navigation and guidance assembly that controls the propulsion and steering assembly to direct the torpedo through the water toward the ship's hull.

The apparatus also includes a targeting sensor and guidance transducer assembly that intercepts information on a location of the ship's hull and communicates the information to the navigation and guidance assembly. The navigation and guidance assembly uses the communicated information to control the propulsion and steering assembly to direct the miniature torpedo through the water to the ship's hull.

BRIEF DESCRIPTION OF THE DRAWINGS

Further features of the invention are set forth in the following description of the invention and in the drawing figures.

DESCRIPTION

Figure 1:
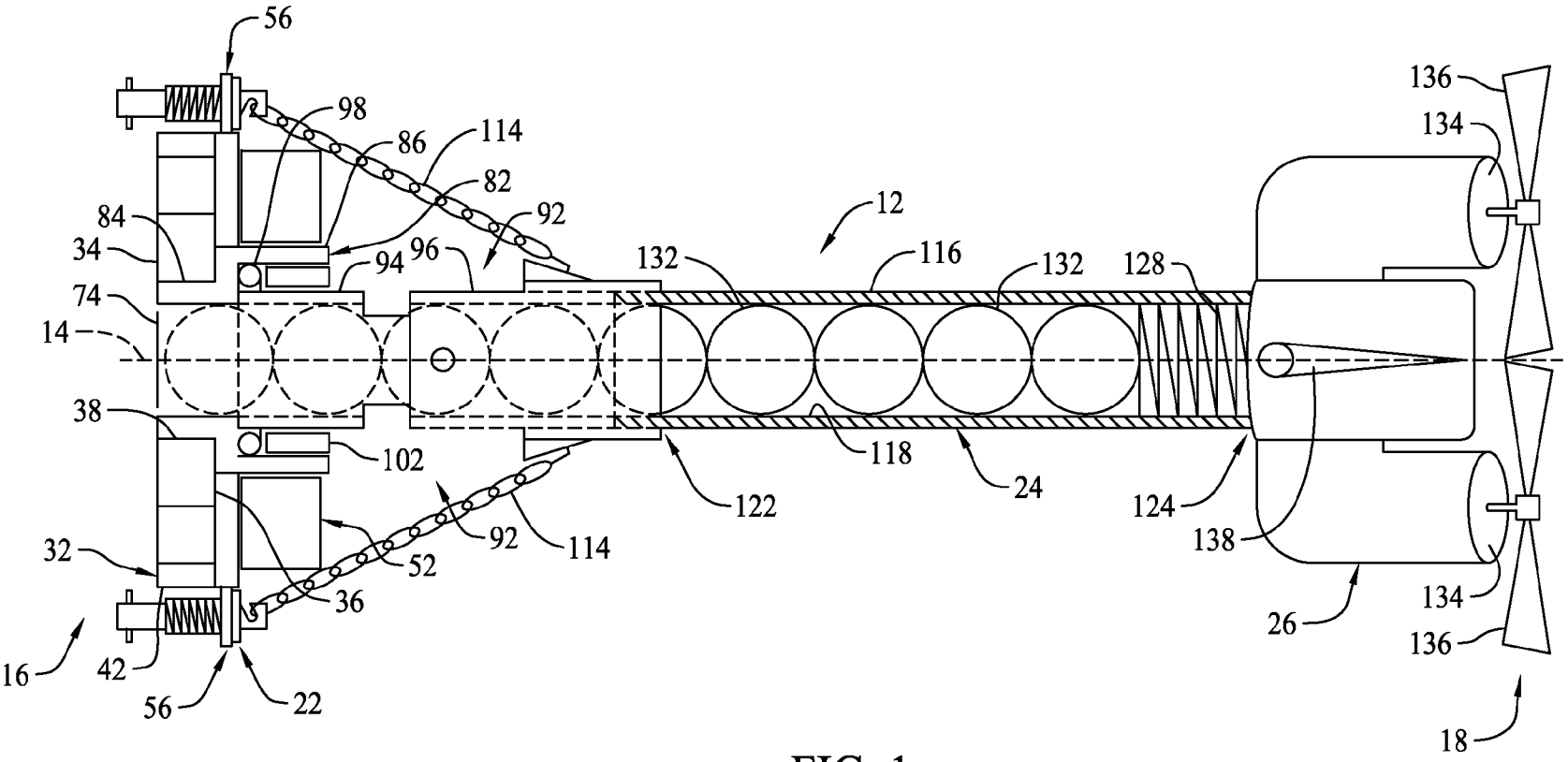
FIG. 1 is an illustration of a side view of the apparatus of the invention.
Figure 2:
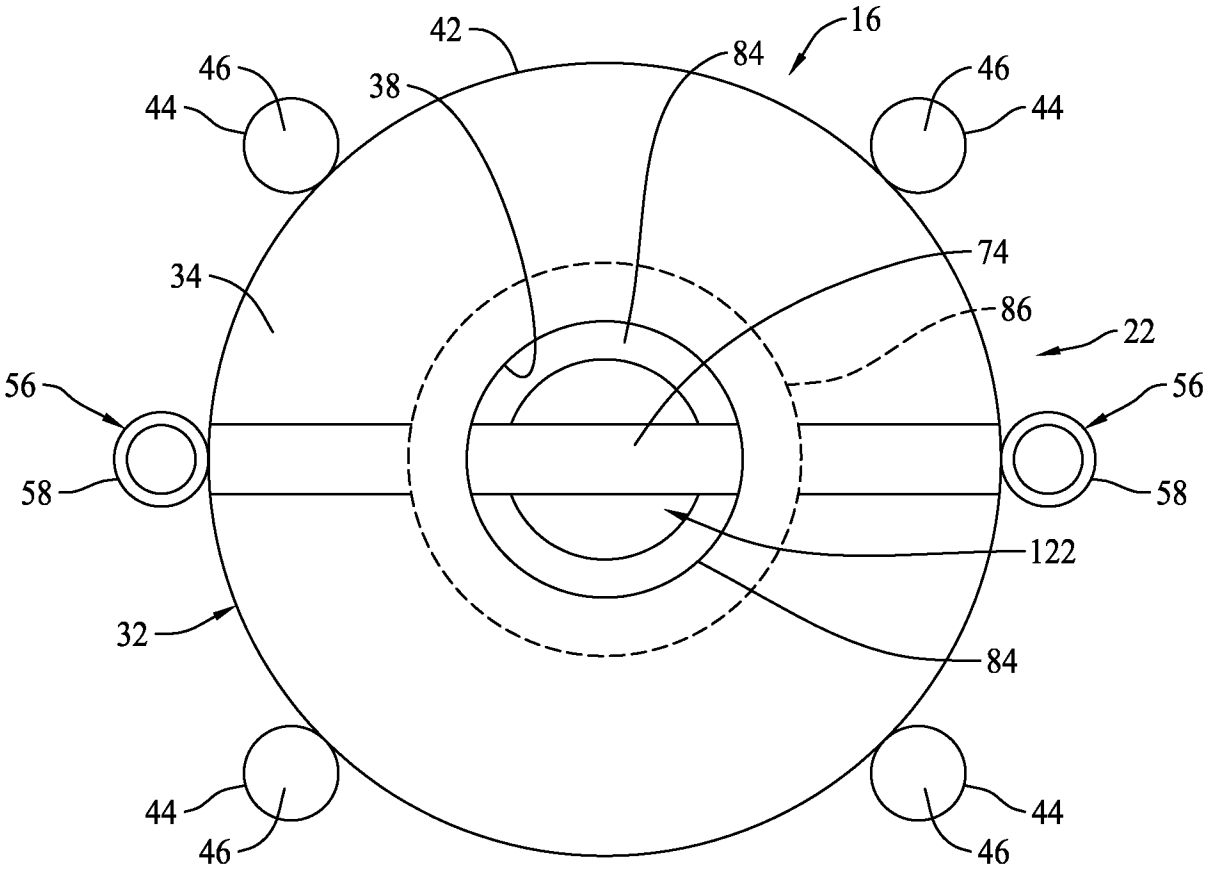
FIG. 2 is a front view illustration of the contact and attachment assembly of the apparatus taken from the left side of the apparatus shown in FIG. 1.
Figure 3:
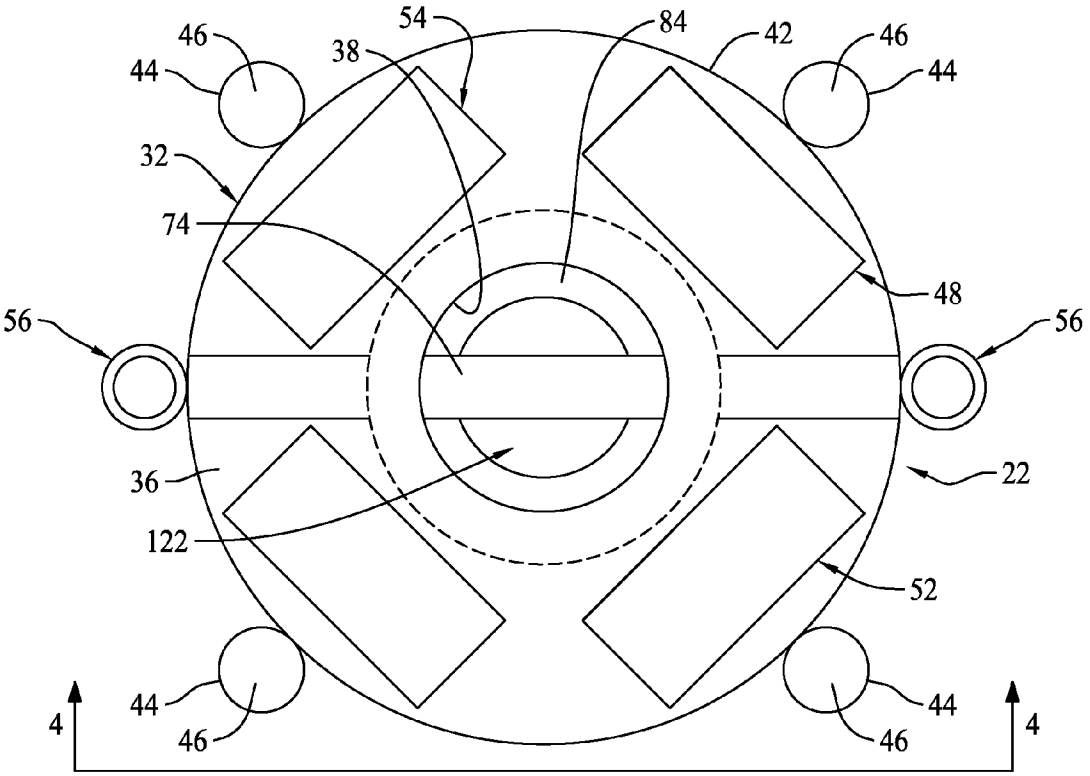
FIG. 3 is a rear view illustration of the contact and attachment assembly shown in FIG. 2.
Figure 4:
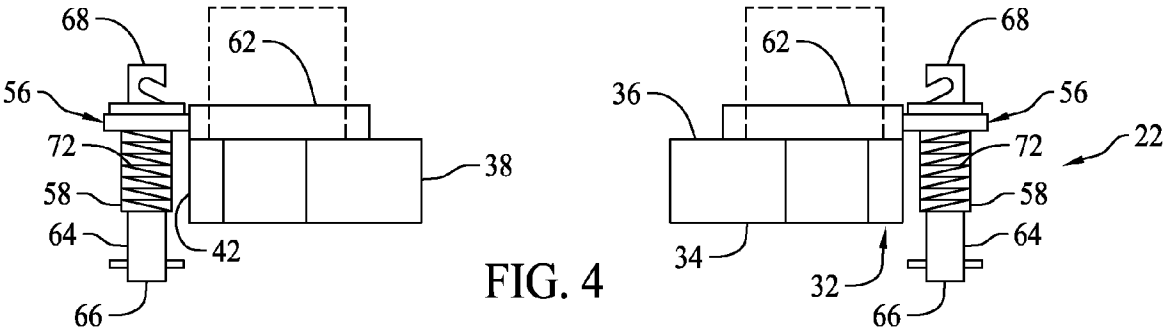
FIG. 4 is a side view illustration of the contact and attachment assembly along the line 4-4 shown in FIG. 3.

FIG. 1 is an illustration of a side view of the miniature torpedo apparatus of the invention 12 showing some of the parts in partial cross-section. The construction of the apparatus 12 to be described is, for the most part, symmetrical around a center axis 14 of the apparatus. The apparatus 12 has an overall axial length from a forward end 16 to a rearward end 18 of the apparatus of approximately 18.5 inches. The component parts of the apparatus 12 are constructed of materials that provide the apparatus 12 with sufficient structural strength for its intended purpose and with the apparatus having an approximate weight of less than 10 pounds. Component parts constructed of specific materials will be identified.

The miniature torpedo 12 is basically comprised of a contact and attachment assembly 22 at the forward end 16 of the apparatus, a chamber 24 operatively connected to the contact and attachment assembly 22 and extending rearwardly thereof, and a propulsion and steering assembly 26 operatively connected to the chamber 24 at the rearward end 18 of the apparatus.

Referring to FIGS. 1-4, a major component part of the contact and attachment assembly 22 is an annular permanent magnet assembly 32. The magnet assembly 32 comprises one or more substantially flat permanent magnets, annular forward surface 34 and an opposite, substantially flat, annular rearward surface 36. The magnet assembly surface 34 has a cylindrical interior surface 38 surrounding a center bore through the magnet assembly 32 and a cylindrical exterior surface 42. The two cylindrical surfaces 38, 42 extend axially between the magnet assembly 32 forward 34 and rearward 36 surfaces. The magnet assembly forward surface 34 is positioned to attach the miniature torpedo 12 to the hull of a ship when the surface makes contact with the hull. The flux field of the magnet assembly surface 34 in addition to the 90 degree, rotational flexibility of the hollow universal joint or u-joint assembly 92, has a sufficient adherence and conformal hydrodynamics to hold the apparatus 12 to a ship's hull even when the ship is underway through water.

Four or more guidance transducer assemblies 44 are secured to the magnet exterior surface 42 at equal circumferentially spaced positions. The transducer assemblies 44 are positioned or oriented parallel with the apparatus center axis 14. Sonic signal receiving surfaces 46 of the assemblies 44 face forwardly of the apparatus. The guidance transducer assemblies 44 function as target sensors.

A sonic navigation guidance assembly 48 is secured to the magnet assembly's rearward surface 36. The sonic navigation guidance assembly 48 communicates with and receives signals from the guidance transducer assemblies 44.

A control system 52, for example, a central processing unit (CPU) 52 is secured to the magnet assembly rearward surface 36. The CPU communicates with the guidance transducer assemblies 44 and the sonic navigation guidance assembly 48 and controls the operations of these assemblies. The CPU also communicates with the propulsion and steering assembly 26 and controls the operation of this assembly.

A power source 54 is also secured to the magnet rearward surface 36, and, or alongside chamber 24. The power source 54 is comprised of one or more batteries and communicates with the guidance transducer assemblies 44, the sonic navigation guidance assembly 48, the CPU 52 and the propulsion and steering assembly 26 and provides power to all these components.

A pair of tethers 114 connects to contact release mechanisms 56, and are secured to the magnet assembly 32 at diametrically opposite sides of the magnet assembly exterior surface 42. Each mechanism 56 has a cylindrical housing 58 that is connected to a base 62. Each base 62 is secured to the magnet assembly's rearward surface 36. The cylindrical housings 58 are positioned at diametrically opposite sides of the magnet assembly's exterior surface 42 with center axes of the cylindrical housings being aligned parallel with the apparatus center axis 14. A plunger 64 is mounted in each cylindrical housing 58 for axial reciprocating movements forwardly and rearwardly through the housing. Each plunger 64 has a forward contact end 66 and an axially opposite hook end 68. Springs 72 in the cylindrical housings 54 bias the plungers 64 forwardly to their positions shown in FIGS. 1 and 4.

A retention and ignition assembly 74 is secured to the magnet assembly 32 at the center of the magnet forward surface 34. The retention and ignition assembly 74 is formed as a flat strip that extends radially across the magnet assembly center bore and then axially across opposite sides of the magnet assembly's cylindrical interior surface 38. The strip 74 is constructed of a material that will ignite and burn when supplied with an electric current, for example magnesium or a magnesium alloy. The strip 74 is connected in communication with the power source 52 through the CPU 54 and its ignition is controlled by the CPU.

Figure 5:
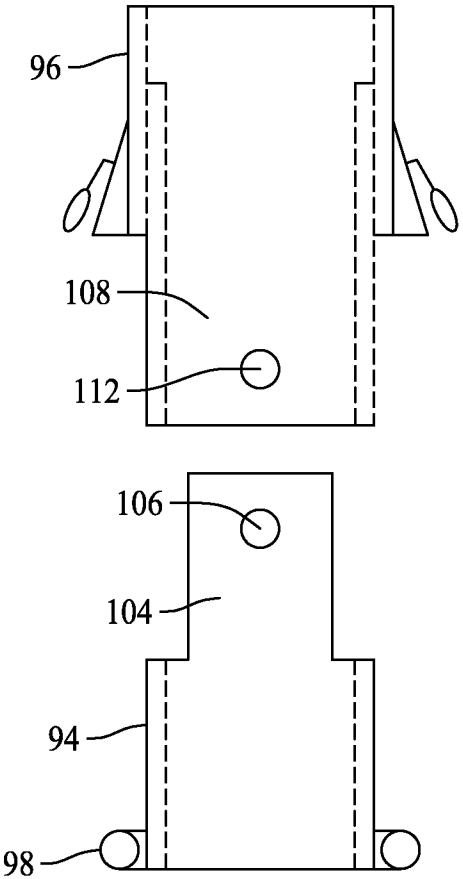
FIG. 5 is an illustration of the component parts of the hollow universal joint disassembled

A cylindrical housing 82 extends into the magnet assembly's center bore and is secured to the magnet assembly interior surface 38 and to a portion of the magnet rearward surface 36. The cylindrical housing 82 is shown in FIGS. 1 and 5. The cylindrical housing 82 has a smaller cylindrical portion 84 that is fit into and secured to the cylindrical interior surface 38 of the magnet assembly 32. A larger cylindrical portion 86 of the housing 82 is secured to the magnet assembly rearward surface 36 and projects rearwardly as it intersects retaining ring 102. The cylindrical housing 82 is constructed of a high heat resistant material, for example a ceramic material.

Figure 6:
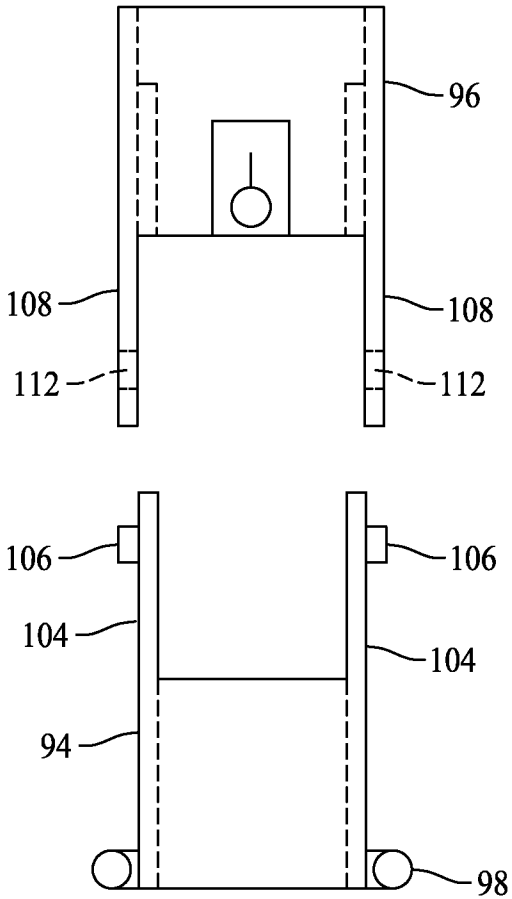
FIG. 6 is an illustration of the component parts of the hollow universal joint disassembled and rotated 90 degrees from their positions shown in FIG. 5.
Figure 7:
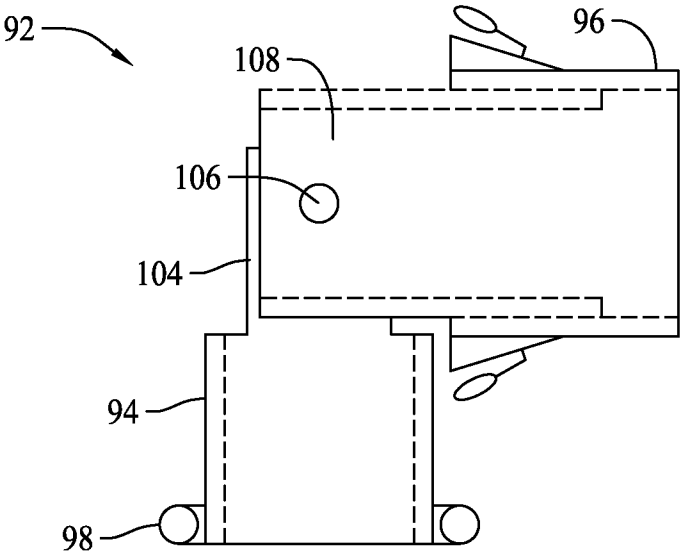
FIG. 7 is an illustration of the hollow universal joint component of the contact and attachment assembly removed from the assembly.
Figure 8:
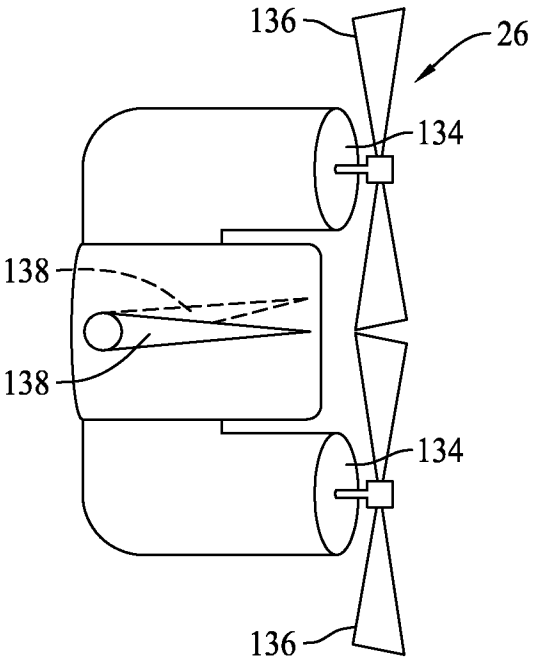
FIG. 8 is an illustration of the propulsion and steering assembly of the apparatus.
Figure 8A:
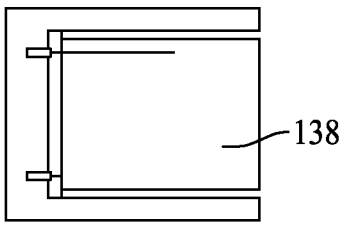
FIG. 8*a* is a side view illustration of a steering assembly fairing having a pivoting rudder removed from the propulsion and steering assembly of FIG. 8.
Figure 9:
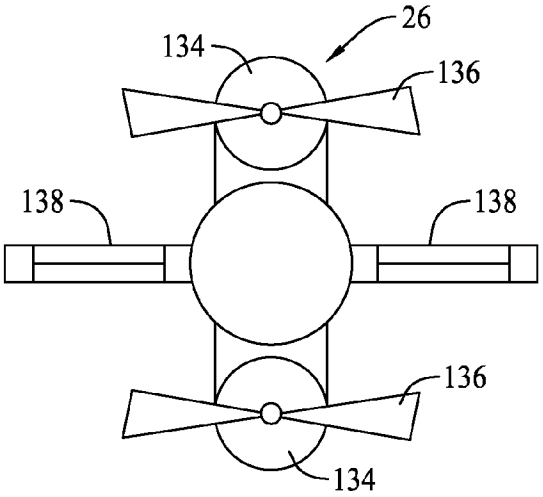
FIG. 9 is a rear view illustration of the propulsion and steering assembly taken from the right side of the assembly shown in FIG. 8.
Figure 10:
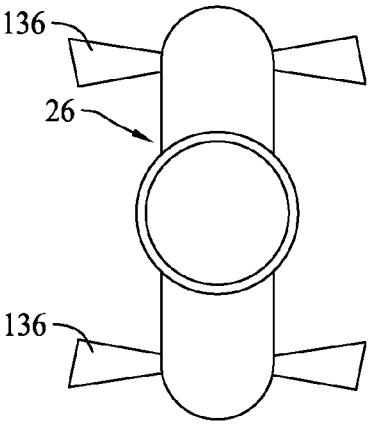
FIG. 10 is a front view illustration of the propulsion and steering assembly taken from the left side of the assembly as shown in FIG. 8.

A hollow universal joint or hollow u-joint assembly 92 is secured inside the large portion 86 of the cylindrical housing 82. The hollow u-joint assembly 92 is comprised of a cylindrical forward portion 94 and a cylindrical rearward portion 96. The joint forward portion 94 has a bearing ring 98 secured to its exterior surface. The bearing ring 98 interfaces the interior surface of the large portion 86 of the cylindrical housing 82, thereby operatively connecting the hollow u-joint assembly 92 to the contact and attachment assembly 22. A retaining ring 102 is press-fit into the large portion 86 of the cylindrical housing 82 to secure the hollow u-joint forward portion 94 to the housing 82. The bearing ring 98 allows the hollow u-joint assembly 92 to rotate freely about the apparatus center axis 14 relative to the contact and attachment assembly 22. The retaining ring 102 prevents the u-joint assembly 92 from moving axially relative to the contact and attachment assembly 22. Referring to FIGS. 5, 6 and 7, the hollow u-joint assembly forward portion 94 has a pair of rearwardly projecting flanges 104 on diametrically opposite sides of the forward portion. Each of the flanges 104 has a pivot post 106 projecting radially outwardly from the flange. The hollow u-joint assembly rearward portion 96 also has a pair of flanges 108 that project forwardly on diametrically opposite sides of the rearward portion 96. Each of these flanges 108 has a pivot post hole 112. As seen in FIG. 5, the pivot post 106 of the u-joint forward portion 94 engage in the pivot post holes 112 of the u-joint rearward portion 96 forming a pivoting connection between the two portions that allows the two portions to pivot to a 90 degree angle.

Together, the bearing ring 98 and the joint assembly between the joint forward portion 94 and the joint rearward portion 96 form a hollow universal joint between the contact and attachment assembly 22 and the joint rearward portion 96 that enables the joint rearward portion 96 to rotate freely around the center axis 14 of the apparatus 12 and allows the joint rearward portion 96 to move through a 180 degree arc relative to the contact and attachment assembly 22.

A pair of tethers 114 are secured to diametrically opposite sides of the joint assembly rearward portion 96. The tethers 114 are shown in the drawing figures as small link chains. However, other equivalent flexible cords could be substituted for the link chains. The tethers extend from the joint assembly rearward portion 96 to the plunger hook ends 68 of the harness contact release mechanisms 56. The springs 72 of the harness contact release mechanisms 56 pull the tethers 114 tight as they extend between the harness contact release mechanisms 56 and the joint assembly rearward portion 96. In this manner, the tethers 114 hold the joint rearward hollow u-joint assembly 96 in a position relative to the contact and attachment assembly 22 shown in FIG. 1 and prevent the hollow u-joint assembly rearward portion 96 from pivoting relative to the contact and attachment assembly.

The tubular chamber 24 is operatively connected between the contact and attachment assembly 22 and the propulsion and steering assembly 26. The chamber 24 has a cylindrical exterior surface 116 and a cylindrical interior surface 118. The chamber 24 has a straight length that extends forward 122 between rearward u-joint assembly 96 and axially opposite rearward end 124 of the chamber. The chamber forward end 122 is open and extends into the joint assembly rearward portion 96 and is secured thereto, thereby operatively connecting the chamber 24 to the contact and attachment assembly 22. The chamber rearward end 124 is closed and is secured to the propulsion and steering assembly 26. The chamber 24 has an interior diameter dimension that is substantially the same as that of the joint assembly rearward portion 96, the hollow u-joint assembly forward portion 94 and the small portion 86 of the cylindrical housing 82. Thus, there is a continuous interior bore that extends through the chamber 24 from the chamber rearward end 124, through the joint assembly 92 and through the permanent magnet assembly 32.

A spring drive mechanism 128 is positioned in the chamber 24 at the chamber rearward end 124. The spring drive mechanism 128 is illustrated in the drawing figures as a coil spring. Other equivalent spring drive mechanisms could be employed instead of the coil spring. The spring drive mechanism 128 is shown in a compressed condition in FIG. 1. In its uncompressed condition the spring drive mechanism 128 extends completely through the continuous interior bore defined through the chamber 24, the hollow u-joint assembly 92 and the magnet assembly 32.

A plurality of flammable elements 132 are contained in the chamber 24, the hollow u-joint assembly 92 and the cylindrical housing 82. Adjacent flammable elements 132 are linked together, for example by a short cord (not shown). The spring drive mechanism 128 urges the flammable elements 132 toward the forward end 16 of the miniature torpedo apparatus 12 where a forward end of the elements 132 engages against and is retained by the retention and ignition assembly 74. Each of the flammable elements 132 has a spherical configuration that can be driven and moved easily through the chamber 24, the hollow u-joint assembly 92 and the cylindrical housing 82 by the spring drive mechanism 128. Each of the elements 132 is constructed of a flammable material such as magnesium or a magnesium alloy that can be easily ignited and will oxidize when ignited and burn at a combustion temperature that is sufficiently high to melt through a metal ship's hull.

The propulsion and steering assembly 26 is operable to drive the apparatus 12 through water to a targeted ship's hull. The assembly 26 is connected in communication with the CPU 52 and operates in response to signals received from the CPU. The assembly 26 includes a pair of electric motors 134 that each drive propellers 136 in rotation. The assembly 26 also includes a pair of pivoting rudders 138 that steer the apparatus 12 through the water in response to signals received from the CPU 52.

Figures 11, 12:
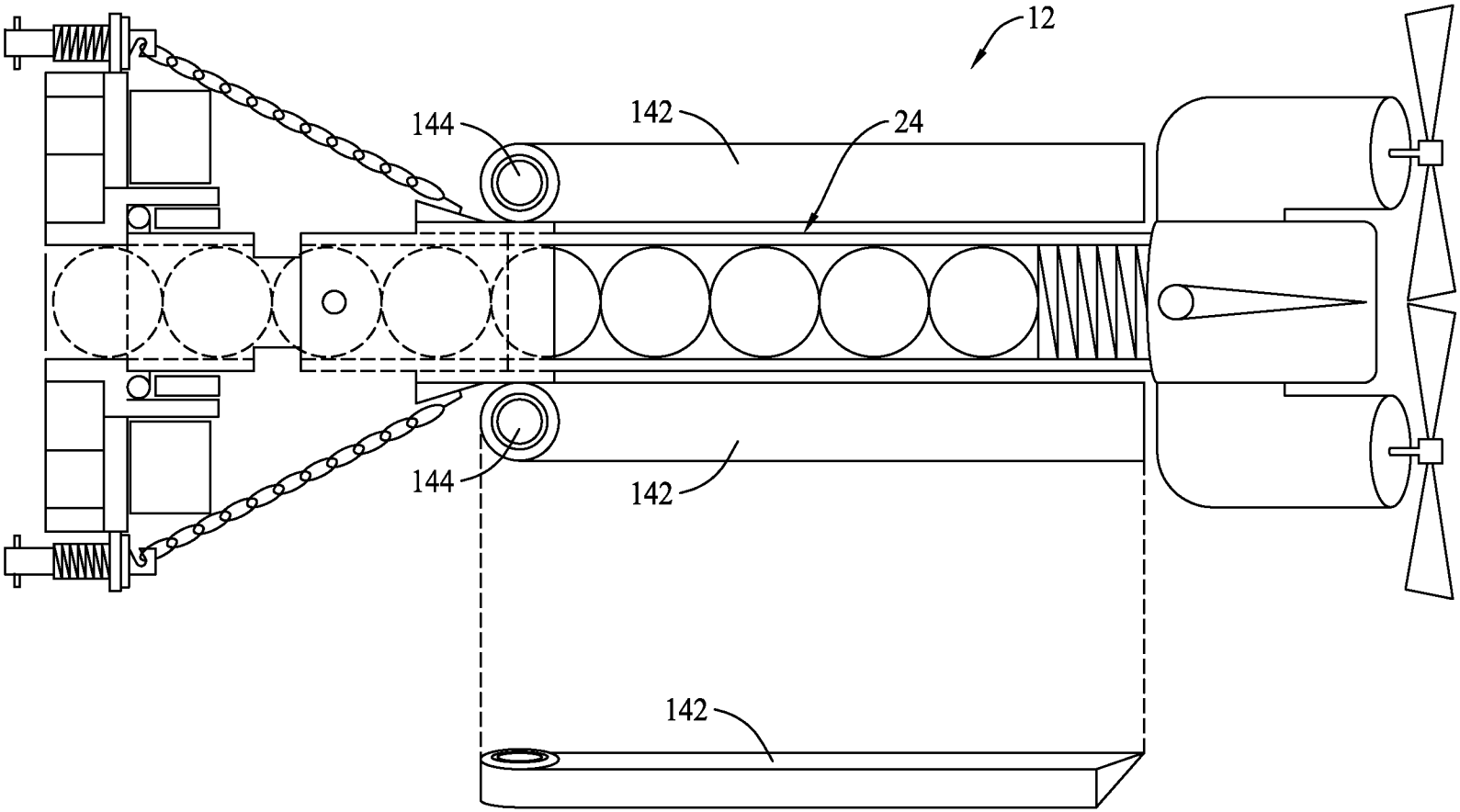
FIG. 11 is an illustration of an alternate embodiment of the torpedo apparatus that employs extended range fairings.
FIG. 12 is an illustration of a fairing of the apparatus shown in FIG. 11 removed from the apparatus.
Figure 13:
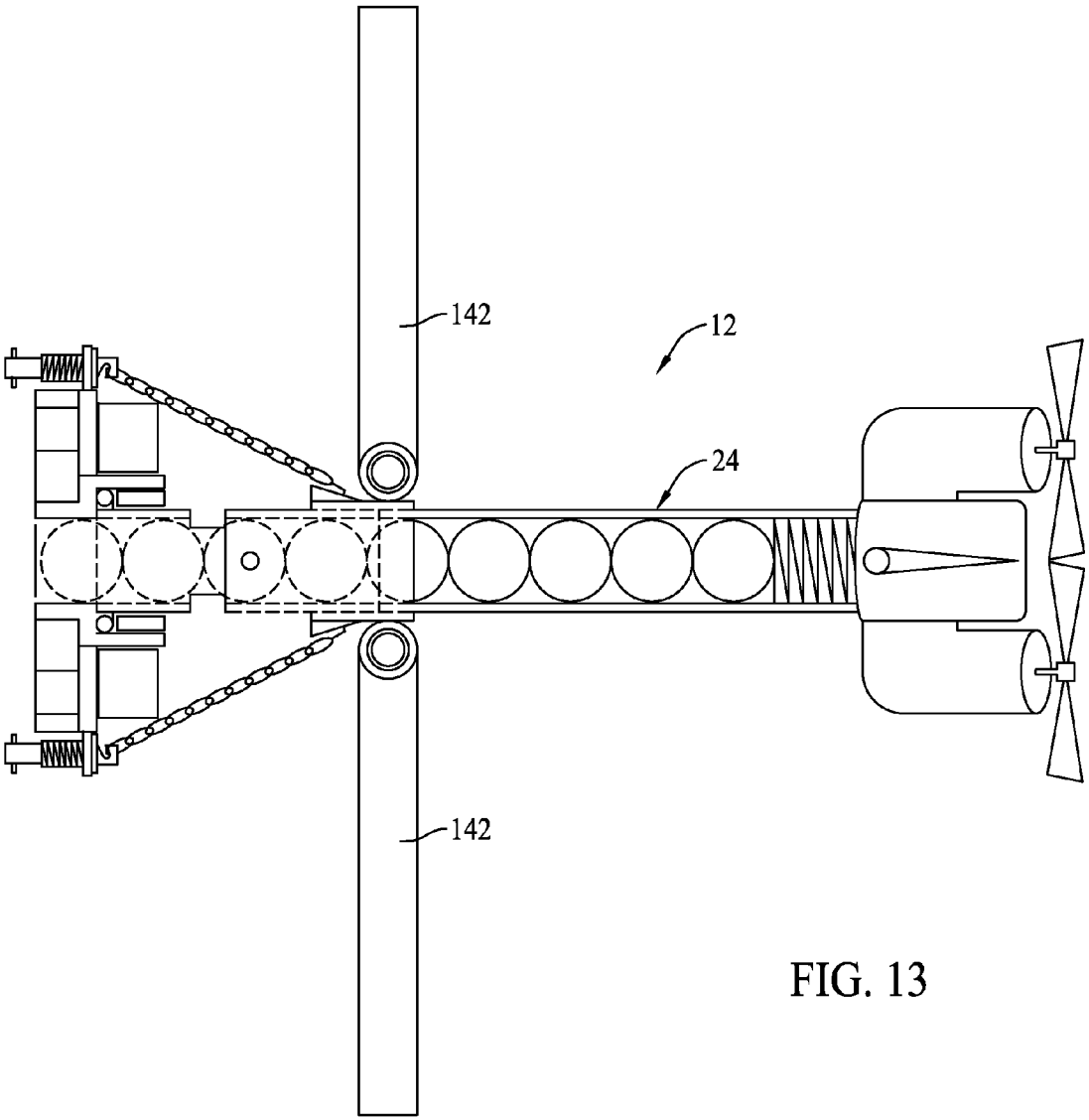
FIG. 13 is an illustration of the apparatus shown in FIG. 11 with the extended range fairings deployed.

FIGS. 11-13 show an alternative embodiment of the apparatus in which a pair of extended range fairings 142 have been added to the apparatus. The fairings 142 are attached to diametrically opposite sides of the chamber 24 by pivoting connections 144. As shown in FIG. 11, the fairings 142 are initially positioned extending along the opposite sides of the chamber 24 when the apparatus is carried by a UAV and launched by the UAV. Once in the water and below the water level, the fairings 142 are deployed to their positions shown in FIG. 13 where the fairings can increase the range of the miniature torpedo apparatus 12 as it travels through water.

Figure 14:
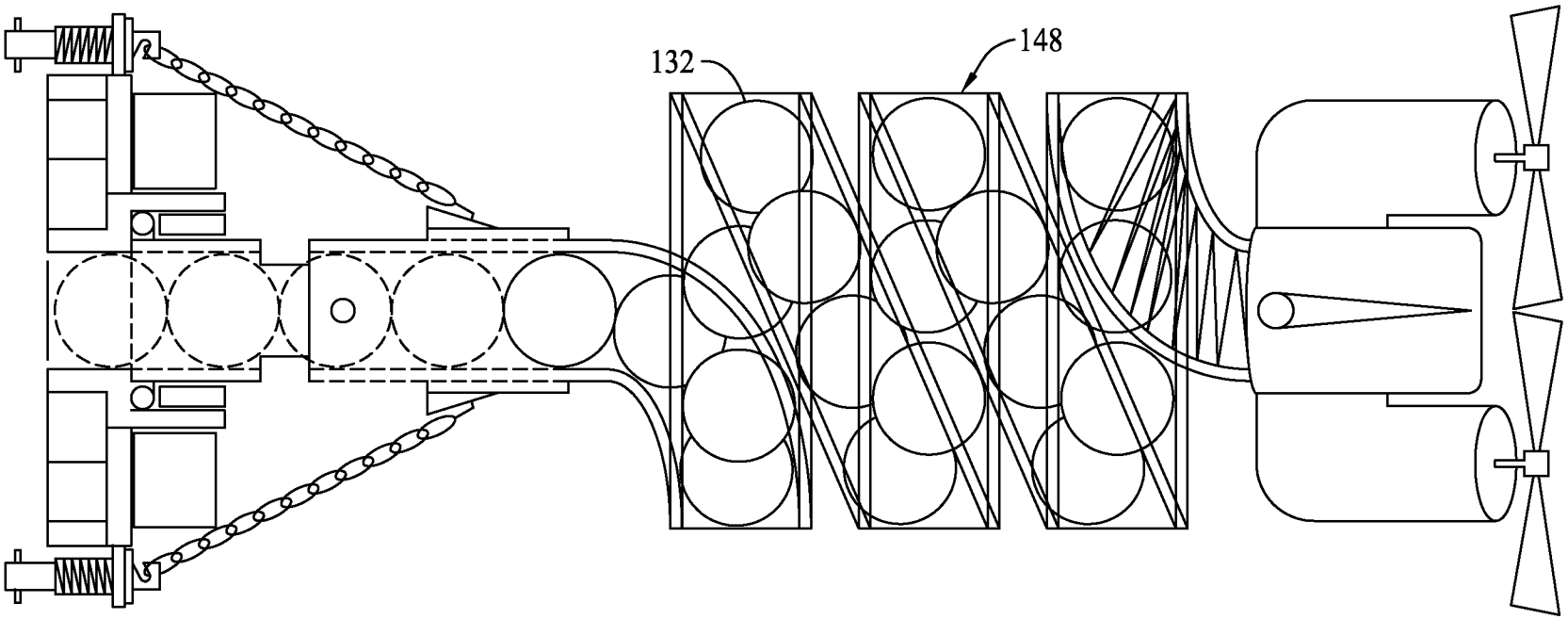
FIG. 14 is an additional illustration of an alternate embodiment of the miniature torpedo apparatus that utilizes a high capacity helical housing for containment of a larger volume of flammable element(s). The helical housing embodiment provides for increased lethality of the miniature torpedo.

An additional alternate embodiment of the apparatus is shown in FIG. 14. In this embodiment, the straight tubular chamber 24 is replaced with a helical tubular chamber 148. The helical tubular chamber 148 increases the number of flammable elements 132 that can be carried by the apparatus. The operation of the embodiment shown in FIG. 14 is substantially the same as that of the embodiment shown in FIG. 1 to be described.

The apparatus 12 is designed to be carried by a UAV to the general geographic area of a ship detected by a remote acoustic sensor. The apparatus 12 is designed to be effective against both surface ships and sub-surface ships. Following detection of the ship by the remote acoustic sensor, a UAV carrying the apparatus 12 will launch or deploy the apparatus 12 in the general geographic area of the detected ship. A small parachute attached to the apparatus 12 will allow it to slowly fall from the UAV to the water surface. Once in the water, the CPU 52 will control the apparatus 12 to release the parachute, target the ship hull with the guidance transducer assemblies 44 and travel to the targeted hull using the sonic navigation guidance assembly 48 and the propulsion and steering assembly 26.

When the targeted ship hull is reached, the apparatus 12 will attach to the metal of the ship hull by the permanent magnet assembly 32. Attachment of the magnet assembly 32 to the ship hull depresses the plungers 64 of the harness contact release mechanism 56 causing the tethers 114 to disengage from the plunger hook ends 68 and freeing the hollow u-joint assembly rearward portion 96 to rotate and pivot relative to the contact and attachment assembly 22. This allows the chamber 24 of the apparatus to rotate around the apparatus center axis 14 and pivot up to 90 degrees to conform the chamber 24 to the hydrodynamic forces of a moving ship hull. The releasing of the harness contact release mechanism 56 also causes the CPU 52 to concurrently trigger the electrical ignition of the retention and ignition assembly 74. This in turn ignites and releases the forward most of the flammable elements 132 to be moved forwardly by the drive mechanism 128 and engage against the ship hull. Once ignited, the combustion temperature of the flammable element 132 will cause the area of the ship's hull engaged by the element to melt and will bore through the hull of the targeted ship. As the combustion of one flammable element 132 is completed it ignites the next in line flammable element which is then pressed against the melting area of the ship hull by the drive mechanism 128. This continues until the burning flammable elements 132 bore a hole through the ship hull.

As various modifications could be made in the construction of the apparatus herein described and illustrated and its method of use without departing from the scope of the invention, it is intended that all matter contained in the foregoing description or shown in the accompanying drawings shall be interpreted as illustrative rather than limiting. Thus, the breadth and scope of the present invention should not be limited by any of the above described exemplary embodiments, but should be defined only in accordance with the following claims appended hereto and their equivalents.

The invention claimed is:

1. A lightweight miniature torpedo apparatus comprising:

a contact and attachment assembly that is operable to attach the apparatus to a ship's hull in response to the contact and attachment assembly coming into contact with the ship's hull;

a chamber operatively connected to the contact and attachment assembly, the chamber containing at least one flammable element that is moveable in the chamber, the chamber containing a drive mechanism that is operable to drive the at least one flammable element from the chamber and toward the ship's hull in response to the contact and attachment assembly attaching the apparatus to the ship's hull; and an ignition assembly connected to the contact and attachment assembly, the ignition assembly being operable to ignite the at least one flammable element as the at least one flammable element is driven toward the ship's hull.

2. The apparatus of claim 1, further comprising:

the at least one flammable element being constructed to oxidize when ignited by the ignition assembly.

3. The apparatus of claim 2, further comprising:

the at least one flammable element being constructed of at least magnesium.

4. The apparatus of claim 1, further comprising:

the at least one flammable element having a combustion temperature that is higher than a melting temperature of a target vessel hull metal.

5. The apparatus of claim 1, further comprising:

the contact and attachment assembly includes a permanent magnet assembly comprising at least one permanent magnet.

6. The apparatus of claim 1, further comprising:

at least a portion of the chamber being constructed of a ceramic material having a melting temperature that is higher than a combustion temperature of the at least one flammable element.

7. The apparatus of claim 1, further comprising:

the chamber containing a plurality of flammable elements and a spring drive mechanism, the spring drive mechanism driving the plurality of flammable elements from the chamber toward the ignition assembly, the ignition assembly being operable to sequentially ignite the plurality of flammable elements.

8. The apparatus of claim 7, further comprising:

the chamber being operatively connected to the contact and attachment assembly by a hollow universal joint that enables the chamber to move in rotation and through an arc relative to the contact and attachment assembly.

9. The apparatus of claim 1, further comprising:

the apparatus being constructed to be carried and launched by an unmanned aerial vehicle, a conventionally manned, anti ship aircraft, and a conventionally manned anti sub-surface ship aircraft.

10. The apparatus of claim 1, further comprising:

a propulsion and steering assembly operatively connected to the contact and attachment assembly and the chamber, the propulsion and steering assembly being operable to propel and direct the apparatus through water.

11. The apparatus of claim 10, further comprising:

a navigation guidance assembly operatively communicating with the propulsion and steering assembly, the navigation guidance assembly being operable to control the propulsion and steering assembly to direct the apparatus through water.

12. The apparatus of claim 11, further comprising:

a targeting sensor assembly operatively communicating with the navigation guidance assembly, the targeting sensor assembly being operable to intercept information on a location of a ship hull and provide the information to the navigation guidance assembly, the navigation guidance assembly being operable to use the information provided by the targeting sensor assembly to control the propulsion and steering assembly to direct the apparatus through the water to the location of the ship hull.

13. A method of using a lightweight miniature torpedo apparatus to damage a ship hull, the method comprising:

providing the apparatus with a contact and attachment assembly and attaching the apparatus to the ship hull below a water line by contacting the ship hull below the water line with the contact and attachment assembly;

providing the apparatus with at least one flammable element having a combustion and oxidation temperature that is higher than a melting temperature of a material of the ship hull and igniting the at least one flammable element;

engaging the ignited flammable element against the material of the ship hull; and melting a portion of the material of the ship hull with the ignited flammable element and thereby producing a hole through the material of the ship hull.

14. The method of claim 13, further comprising:

providing the apparatus with a propulsion and steering assembly and propelling and directing the apparatus through the water to the ship hull.

15. The method of claim 13, further comprising:

carrying the apparatus by an aerial vehicle and launching the apparatus from the aerial vehicle to below the water line.

16. The apparatus of claim 13, further comprising:

providing the apparatus with a plurality of flammable elements; and sequentially igniting each flammable element of the plurality of flammable elements and engaging the ignited flammable element with the material of the ship hull.

17. A lightweight miniature torpedo apparatus comprising:

a chamber having a length with opposite forward and rearward ends and an interior bore extending through the length of the chamber;

at least one flammable element in the chamber interior bore;

a spring mechanism in the chamber interior bore, the spring mechanism urging the at least one flammable element toward the chamber forward end;

a contact and attachment assembly at the chamber forward end, the contact and attachment assembly including a permanent magnet assembly that is operable to attach the apparatus to a ship's hull in response to the contact and attachment assembly coming into contact with the ship's hull; and a retention and ignition assembly at the chamber forward end, the retention and ignition assembly being operable to retain the at least one flammable element in the chamber interior bore against the urging of the spring mechanism and being operable to ignite the at least one flammable element and release the at least one flammable element from the chamber interior bore enabling the spring mechanism to urge the at least one flammable element through the chamber interior bore and then into the ship's hull.

18. The apparatus of claim 17, further comprising:

the chamber being operatively connected to the contact and attachment assembly by a hollow universal joint that enables the chamber to move in rotation and through an arc relative to the contact and attachment assembly.

19. The apparatus of claim 17, further comprising:

the at least one flammable element being one of a plurality of separate elements comprised of at least magnesium contained in the chamber interior bore, the spring mechanism urging the plurality of elements through the chamber interior bore toward the retention and ignition assembly, and the retention and ignition assembly being operable to retain the plurality of elements in the chamber interior bore against the urging of the spring mechanism and being operable to ignite at least one element of the plurality of elements and then release the elements from retention in the chamber interior bore enabling the spring mechanism to urge the plurality of elements through the chamber interior bore and toward the chamber forward end.

20. The apparatus of claim 17, further comprising:

a propulsion and steering assembly at the chamber rearward end, the propulsion and steering assembly being operable to propel and direct the apparatus through water.

* * * * *